US005597297A

United States Patent [19]

Yamamoto et al.

[11] Patent Number: 5,597,297

[45] Date of Patent: Jan. 28, 1997

[54] SCROLL TYPE COMPRESSOR

[75] Inventors: Shinya Yamamoto; Tetsuhiko Fukanuma; Shigeru Hisanaga, all of Kariya, Japan

[73] Assignees: Kabushiki Kaisha Toyoda Jidoshokki Seisakusho; Nippondenso Co., Ltd., both of Kariya, Japan

[21] Appl. No.: 507,039

[22] Filed: Jul. 25, 1995

[30] Foreign Application Priority Data

Jul. 27, 1994 [JP] Japan ..... 6-175751

[51] Int. Cl.[6] ..... F01C 1/04

[52] U.S. Cl. ..... 418/55.1; 418/151

[58] Field of Search ..... 418/55.1, 55.3, 418/151, 179

[56] References Cited

U.S. PATENT DOCUMENTS 4,406,600 9/1983 Terauchi et al. ..... 418/55.3
4,808,094 2/1989 Sugimoto et al. .
5,040,958 8/1991 Arata et al. .
5,165,879 11/1992 Kondo et al. .
5,199,862 4/1993 Kondo et al. .
5,310,324 5/1994 Taniguchi et al. ..... 418/151

FOREIGN PATENT DOCUMENTS 494483 3/1992 Japan .

*Primary Examiner*—Charles G. Freay
*Attorney, Agent, or Firm*—Brooks Haidt Haffner & Delahunty

[57] ABSTRACT

A compressor has a fixed scroll and a movable scroll which has a first surface and a second surface. The first surface is opposed to the fixed scroll to define a displaceable fluid pocket. The movable scroll is supported on a rotary shaft via an eccentric pin to move along a predetermined orbit around an axis of the rotary shaft. Gas is introduced into and compressed in the fluid pocket. A boss is formed with the second surface of the movable scroll. A bushing is supported on the eccentric pin and rotatably received by the boss. The rotary shaft has an inner end surface for securely supporting the eccentric pin. A holding member engages the eccentric pin to hold the bushing in a predetermined position on the eccentric pin in corporation with the inner surface of the rotary shaft. A balance weight is secured around the bushing to cancel a dynamic imbalance of the movable scroll due to the orbital movement of the movable scroll.

22 Claims, 4 Drawing Sheets

SCROLL TYPE COMPRESSOR

BACKGROUND OF THE INVENTION

1. Field of the Invention

The present invention relates to a scroll type compressor for use in, for example, an air conditioning system for a vehicle. More specifically, this invention relates to a structure for reducing noise during running of a compressor.

2. Description of the Related Art

A typical scroll type compressor comprises a fixed scroll and a movable scroll each having an end plate and a spiral element. The spiral element of the movable scroll engages with the spiral element of the fixed scroll, forming pockets between both spiral elements. As the rotary shaft rotates, the movable scroll revolves about the axial center of the fixed scroll. In accordance with the revolution of the movable scroll, the pockets shift toward the center portions of both spiral elements from the peripheral portions thereof, reducing their volumes. Consequently, refrigerant gas is compressed in the pockets.

Japanese Unexamined Patent Publication No. Hei 4-94483 discloses this type of compressor. As shown in FIGS. 3 and 4, this compressor has an eccentric pin 73 attached to the internal end face 76*a* of the rotary shaft 76. A bushing 74 is attached to the eccentric pin 73. A movable scroll 71 has a boss 72 provided at the front end of the end plate. This boss 72 is fitted via a bearing 75 on the bushing 74 in a relatively rotatable fashion. A balance weight 77 is attached to the eccentric pin 73 between the opposing end faces of the rotary shaft 76 and bushing 74. This balance weight 77 cancels the centrifugal force, which acts on the movable scroll 71 to maintain good dynamic balance of the movable scroll 71 while the compressor is running. A groove 78 is formed in the outer surface of the distal end of the eccentric pin 73, with a ring-like fastening plate 79 engaged in this groove 78. The fastening plate 79 inhibits the movements of the bushing 74 and balance weight 77 in the axial direction of the eccentric pin 73 to prevent those components 74 and 77 from coming off the eccentric pin 73.

However, this compressor may generate noise from around the eccentric pin 73. This noise originates from the rattling of the bushing 74 and balance weight 77 in the axial direction of the eccentric pin 73 between the internal end face 76*a* of the rotary shaft 76 and the fastening plate 79.

The axial-direction dimensions of the bushing 74, balance weight 77 and fastening plate 79 are respectively denoted by $\alpha$, $\beta$ and $\gamma$. If the distance $\delta$ from the internal end face 76*a* of the rotary shaft 76 to the groove 78 is the maximum allowable distance and the widths $\alpha$, $\beta$ and $\gamma$ of the components 74, 77 and 79 are the minimum allowable widths, the rattling of the bushing 74 and balance weight 77 will be maximized The greater the rattling becomes, the higher the noise level gets while the compressor is in operation.

To suppress the rattling, the dimensional tolerance of the mentioned individual components should be minimized. This requires that the individual components be machined with high precision, making the machining of the individual components difficult. This results in an inevitable increase in manufacturing cost.

SUMMARY OF THE INVENTION

Accordingly, it is a primary objective of the present invention to provide a scroll type compressor which suppresses the rattling of its bushing and balance weight to thereby reduce the noise level while the compressor is running.

It is another objective of this invention to provide a scroll type compressor which can be worked easily.

To achieve the above objects, the compressor according to the present invention has a fixed scroll and a movable scroll which has a first surface and a second surface. The first surface is opposed to the fixed scroll to define a displaceable fluid pocket. The movable scroll is supported on a rotary shaft via an eccentric pin to move along a predetermined orbit around an axis of the rotary shaft. Gas is introduced into and compressed in the fluid pocket. A boss is formed with the second surface of the movable scroll. A bushing is supported on the eccentric pin and rotatably received by the boss. The rotary shaft has an inner end surface for securely supporting the eccentric pin. A holding member engages the eccentric pin to hold the bushing in a predetermined position on the eccentric pin in cooperation with the inner surface of the rotary shaft. A balance weight is secured around the bushing to cancel a dynamic imbalance of the movable scroll due to the orbital movement of the movable scroll.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiment together with the accompanying drawings in which:

DETAILED DESCRIPTION OF THE PREFERRED EMBODIMENT

A scroll type compressor according to a preferred embodiment of the present invention will now be described referring to FIG. 1 and 2.

Figure 1:
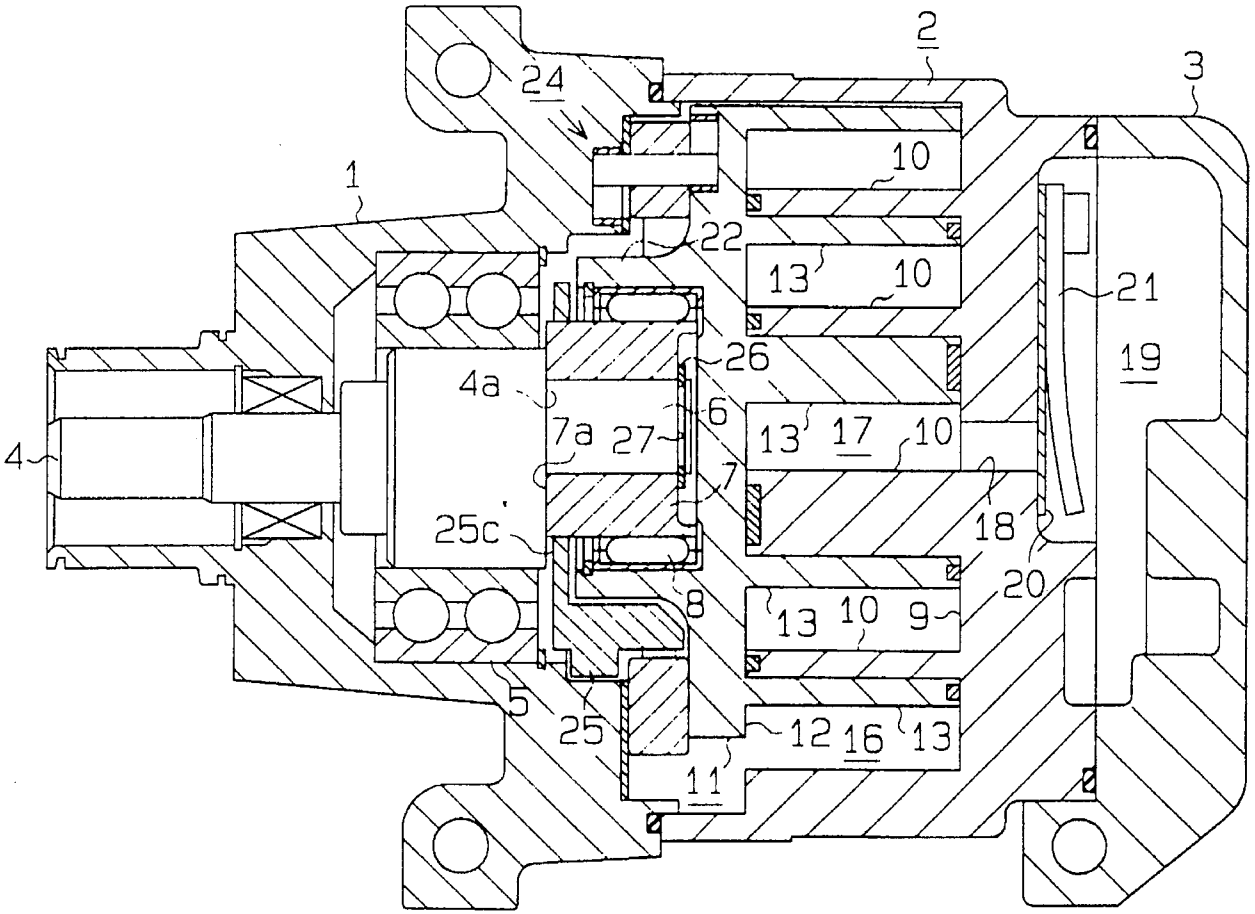
FIG. 1 is a cross-sectional view showing an overall scroll type compressor according to one embodiment of the present invention.

As shown in FIG. 1, a fixed scroll 2 also serves as a center housing. A front housing 1 is connected to the front end face of the fixed scroll 2 by bolts (not shown). A rear housing 3 is connected to the rear end face of the fixed scroll 2 by bolts (not shown). A rotary shaft 4 is rotatably supported via a main bearing 5 in the front housing 1. An eccentric pin 6 protrudes from the internal end face 4*a* of the rotary shaft 4. A bushing 7 is attached to the eccentric pin 6, with a bearing 8 fitted around the bushing 7. Both the rotary shaft 4 and the bushing 7 are made of iron steel base material. In this embodiment, the bushing 7 is made of chrome steel.

The movable scroll 11 is supported via the bearing 8 on the bushing 7 in a relatively rotatable manner. The fixed scroll 2 has an end plate 9 and a spiral element 10 integrally formed on the inner wall of the end plate 9. Likewise, the movable scroll 11 has an end plate 12 and a spiral element 13 integrally formed on the inner wall of the end plate 12. The spiral elements 10 and 13 of both scrolls 2 and 11 engage with each other. The movable scroll 11 is provided a boss 22 on the outer surface of the end plate 12. This boss 22 is fitted via the bearing 8 on the bushing 7. When the rotary shaft 4 rotates, the eccentric pin 6 allows the movable scroll 11 to revolve about the axial center of the rotary shaft 4 via the bushing 7 and bearing 8.

A rotation preventing mechanism 24 is located between the inner wall of the front housing 1 and the outer surface of the end plate 12 of the movable scroll 11. This rotation preventing mechanism 24 inhibits the rotation of the movable scroll 11 about its axial center and permits the revolution of the movable scroll 11 around the axial center of the rotary shaft 4.

A suction chamber 16 is formed between the peripheral portion of the spiral element 10 of the fixed scroll 2 and the peripheral portion of the spiral element 13 of the movable scroll 11. Refrigerant gas is supplied into the suction chamber 16 via an inlet (not shown) which is formed in the front housing 1. Pockets 17 are formed between the end plates 9 and 12 and the spiral elements 10 and 13 of both scrolls 2 and 11. A discharge chamber 19 is formed in the rear housing 3. A discharge port 18 is formed in the center of the end plate 9 of the fixed scroll 2 to connect the pockets 17 to the discharge chamber 19. A discharge valve 20 which opens or closes the discharge port 18 is disposed on the outer surface of the end plate 9, and the open angle of the valve 20 is restricted by a stopper 21.

Figure 2:
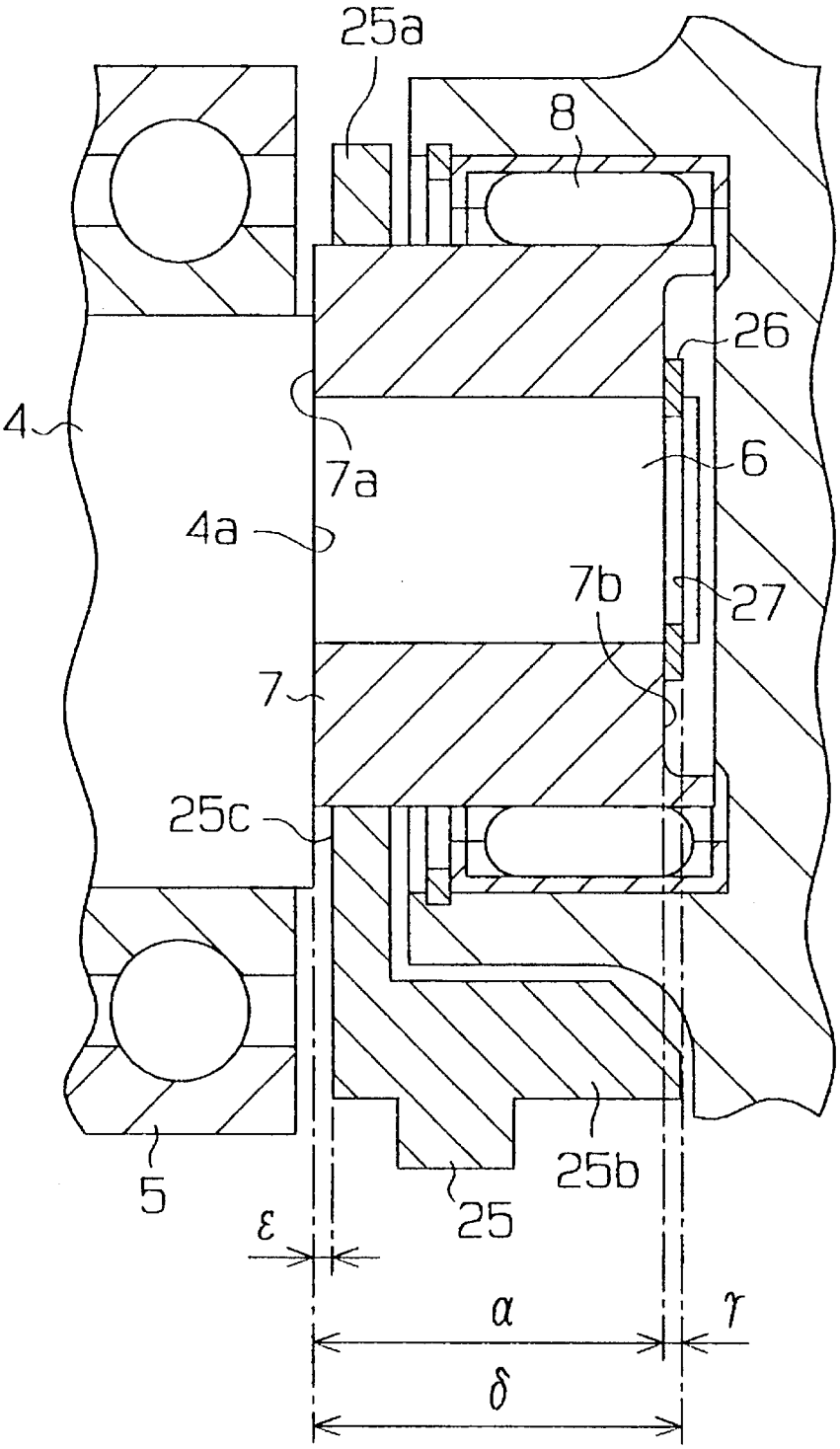
FIG. 2 is an enlarged cross-sectional view showing a portion of the compressor shown in FIG. 1.
Figure 3:
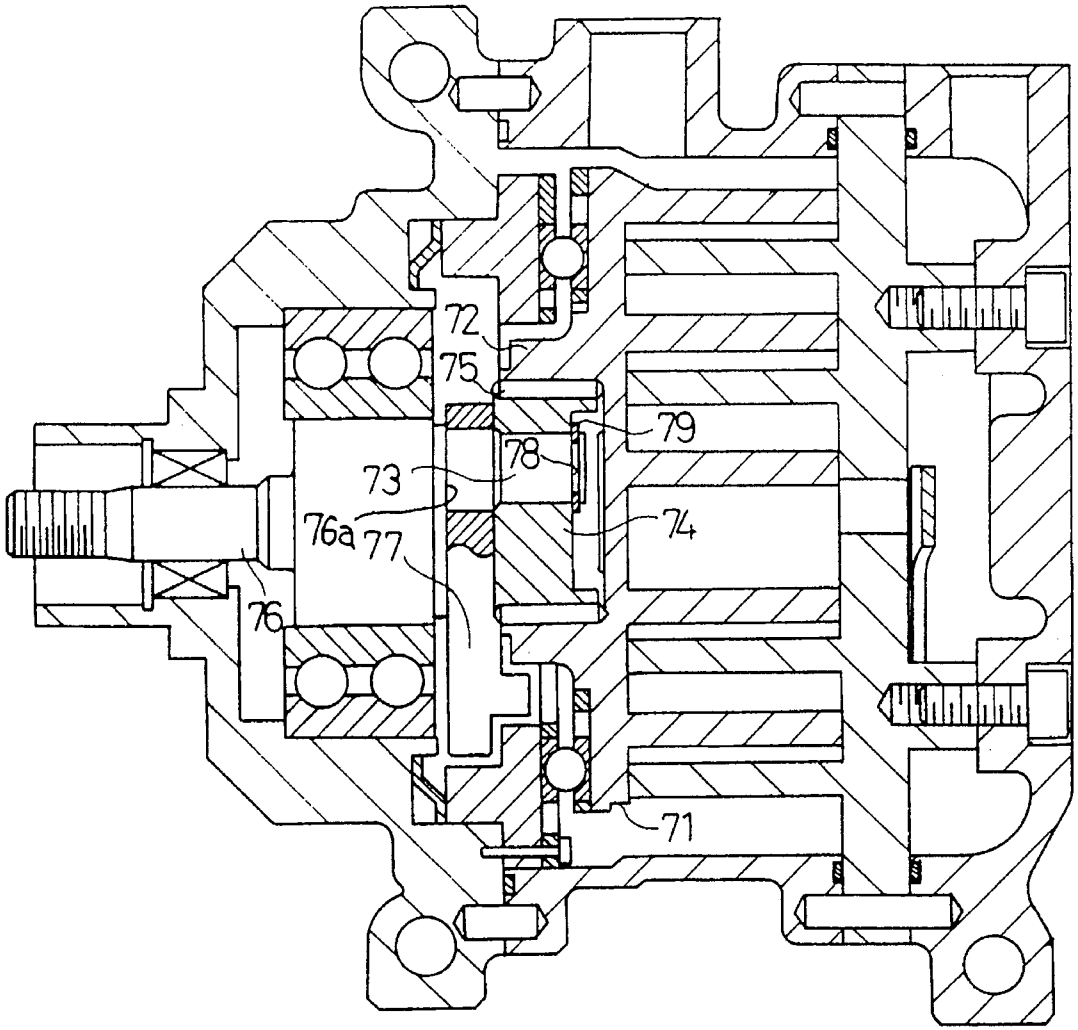
Fig.3 (Prior Art)
FIG. 3 is a cross-sectional view showing a prior art scroll type compressor.

As shown in FIGS. 1 and 2, a groove 27 is formed in the outer surface of the distal end of the eccentric pin 6, with a ring-like fastening plate 26 engaged in the groove 27. The fastening plate 26 inhibits the movements of the bushing 7 in the axial direction of the eccentric pin 6 to prevent the bushing 7 from coming off the eccentric pin 6. The bushing 7 has a front end face **7*a* which contacts the internal end face 4*a* of the rotary shaft 4 and a rear end face 7*b* which contacts the fastening plate 26**.

A balance weight 25 is fitted on the outer surface of the bushing 7 between the internal end face **4*a* of the rotary shaft 4 and the boss 22 by press fitting, so that it rotates together with the bushing 7. The balance weight 25 is made of iron steel base material or copper base material. In this embodiment, the balance weight 25** is made of carbon steel (S35C according to JIS regulation).

The balance weight 25 has a ring-like fixed portion **25*a* which is fitted on the outer surface of the bushing 7 and a weight portion 25*b* integrally formed on a portion around the fixed portion 25*a*. The fixed portion 25*a* is arranged between the internal end face 4*a* and the boss 22. The weight portion 25*b* is rotatable around the boss 22. The balance weight 25 is attached in such a manner that its front end face (the end face which faces the internal end face 4*a* of the rotary shaft 4) 25*a* is located rearward of the front end face 7*a* of the bushing 7 at a predetermined distance $\epsilon$ therebetween. In other words, the front end face 25*a* of the balance weight 25 is positioned between both end faces 7*a* and 7*b* of the bushing 7 without contacting the internal end face 4*a* of the rotary shaft 4**.

When the rotary shaft 4 in the thus constituted compressor rotates, the movable scroll 11 revolves about the axial center of the rotary shaft 4 together with the eccentric pin 6. In accordance with the revolution of the movable scroll 11, refrigerant gas is fed into the pockets 17 between both scrolls 2 and 11 from the suction chamber 16. In accordance with the revolution of the movable scroll 11, the pockets 17 shift toward the center portions of both spiral elements 10 and 13 from the peripheral portions thereof, reducing their volumes. Consequently, refrigerant gas is gradually compressed in the pockets 17, and forcibly opens the discharge valve 20 through the discharge port 18 to be discharged into the discharge chamber 19. At this time, the dynamic imbalance of the movable scroll 11, which originates from the centrifugal force and compressive reactive force that has been produced by the revolution of the movable scroll 11 and the compression of the refrigerant gas, is canceled by the action of the balance weight 25. It is therefore possible to keep a good dynamic balance of the movable scroll 11 while the compressor is running, thus allowing the movable scroll 11 to smoothly revolve.

In this embodiment, the balance weight 25 is secured on the outer surface of the bushing 7 by press fitting and the front end face **7*a* of the bushing 7 directly contacts the internal end face 4*a* of the rotary shaft 4. That is, the balance weight 25, unlike the one in the prior art, is not located between the internal end face 4*a* of the rotary shaft 4 and the front end face 7*a* of the bushing 7, so that the front end face 7*a* of the bushing 7 comes in direct contact with the internal end face 4*a* of the rotary shaft 4. Accordingly, the bushing 7 alone is disposed between the internal end face 4*a* of the rotary shaft 4 and the fastening plate 26, and the contact of this bushing 7 with the internal end face 4*a* and the fastening plate 26 inhibits the bushing 7 from moving in the axial direction of the eccentric pin 6. As the balance weight 25 is secured to the outer surface of the bushing 7, no member is needed to restrict the movement of the balance weight 25. Further, the balance weight 25 does not rattle with respect to the bushing 7**.

Figure 4:
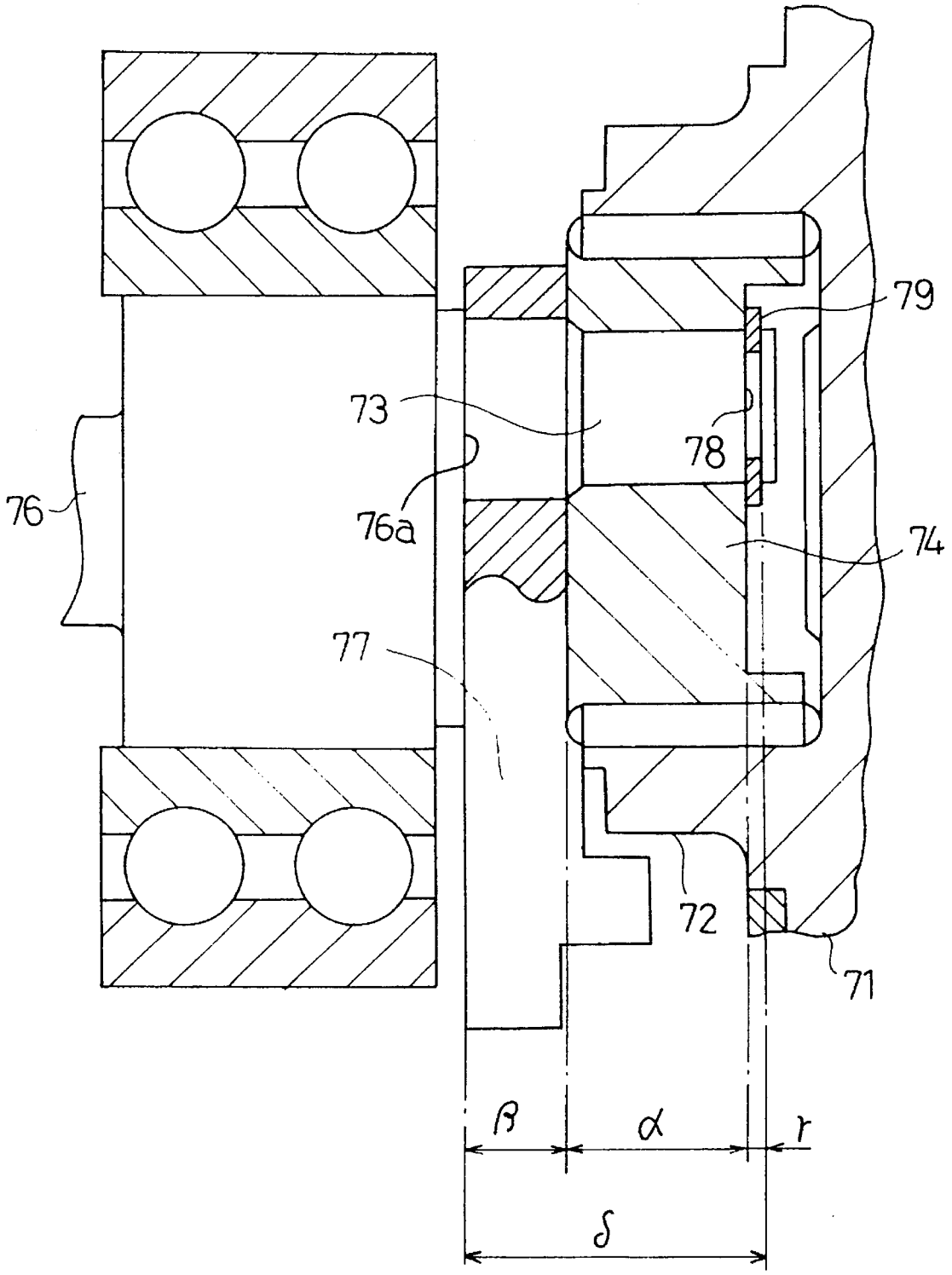
Fig.4 (Prior Art)
FIG. 4 is an enlarged cross-sectional view showing a portion of the compressor shown in FIG. 3.

In the prior art, as shown in FIG. 4, the degree of rattling of the member located between the internal end face **76*a* of the rotary shaft 76 and the fastening plate 79 is influenced by the width $\beta$ of the balance weight 77 as well as the width $\alpha$ of the bushing 74, the width $\gamma$ of the fastening plate 79 and the distance $\delta$ from the internal end face 76*a* to the groove 78. According to this embodiment, however, the degree of rattling of the member located between the internal end face 4*a* of the rotary shaft 4 and the fastening plate 26 is influenced only by the width $\alpha$ of the bushing 7, the width $\gamma$ of the fastening plate 26 and the distance $\delta$ from the internal end face 4*a* to the groove 27; not by the width of the balance weight 25**.

Even if the distance $\delta$ is set to the maximum allowable distance and the widths $\alpha$ and $\gamma$ of the individual components 7 and 26 are set to the minimum allowable widths, therefore, this design can reduce the rattling of the member disposed between the internal end face **4*a* of the rotary shaft 4 and the fastening plate 26, i.e., the rattling of the bushing 7, as compared with the prior art. In other words, the rattling of the bushing 7 is reduced and the noise level while the compressor is running is suppressed without requiring high-precision machining of the compressor parts. In order to reduce the rattling, even when the individual components are machined with precision to reduce their dimensional allowances, the machining precision of the balance weight 25 need not be considered. It is therefore easier to manufacture at least the balance weight 25**.

The balance weight 25 is so attached that its front end face **25*c* is located rearward of the front end face 7*a* of the bushing 7 at a predetermined distance $\epsilon$. This distance $\epsilon$ is not a strict value, but has only to be slightly greater than zero. It is therefore possible to provide a sufficient mounting allowance for the balance weight 25 and a sufficient dimensional allowance for the width of the balance weight 25 with respect to the bushing 7. This makes the machining of the balance weight 25 easier. While the balance weight 25 does not contact the internal end face 4*a* of the rotary shaft 4, the bushing 7 surely contacts this internal end face 4*a*. The bushing 7 is therefore accurately positioned where it contacts the internal end face 4***a* of the rotary shaft 4.

The bushing 7 and the balance weight 25 are separately formed. This makes the manufacturing process easier. Additionally, the bushing 7 and the balance weight 25 can be formed of the different materials. For example, the bushing 7 can be made of the chrome steel which has a high hardenability. This increases a durability of the bushing 7 which tends to receive various forces due to the revolution of the movable scroll 11. The balance weight 25 can be made of the copper having a specific gravity larger than the bushing 7. This allows the balance weight 25 to be compact.

Therefore, the present embodiment is to be considered illustrative and not restrictive and the invention is not to be limited to the details given herein, but may be modified within the scope of the appended claims.

What is claimed is:

1. A compressor comprising: a rotary shaft, a fixed scroll and a movable scroll having a first surface and a second surface, said first surface being opposed to said fixed scroll to define a displaceable fluid pocket, said movable scroll being supported on said rotary shaft via an eccentric pin to move along a predetermined orbit around an axis of said rotary shaft, wherein gas is introduced into and compressed in said fluid pocket;

a boss formed with said second surface of said movable scroll;

a bushing supported on said eccentric pin and rotatably received by said boss;

said rotary shaft having an inner end surface for securely supporting said eccentric pin;

a holding member engaging said eccentric pin to hold said bushing in a predetermined position on said eccentric pin in cooperation with said inner end surface of said rotary shaft;

said bushing comprising a first end surface contacting said inner end surface of said rotary shaft and a second end surface contacting said holding member; and a balance weight secured around said bushing to cancel a dynamic imbalance of said movable scroll due to the orbital movement of said movable scroll, said balance weight comprising an end surface disposed between said first and second end surfaces of said bushing, said end surface of said balance weight being opposed to and spaced from said inner end surface of said rotary shaft.

2. The compressor as set forth in claim 1, wherein said balance weight is press fitted onto said bushing.

3. The compressor as set forth in claim 1, wherein said eccentric pin has a groove extending therearound, and wherein said holding member has a ring shape conforming with said groove.

4. The compressor as set forth in claim 1, wherein said bushing comprises chrome steel, and wherein said balance weight comprises carbon steel.

5. The compressor as set forth in claim 1, further including a bearing disposed between said bushing and said boss.

6. The compressor as set forth in claim 1, wherein said balance weight has a ring-shaped fixed portion secured to said bushing and a weight portion integrally formed with said fixed portion.

7. The compressor as set forth in claim 6, wherein said fixed portion is disposed between said boss and said inner end surface of said rotary shaft, and said weight portion is rotatable around said boss.

8. A compressor comprising: a rotary shaft, a fixed scroll and a movable scroll having a first surface and a second surface, said first surface being opposed to said fixed scroll to define a displaceable fluid pocket, said movable scroll being supported on said rotary shaft via an eccentric pin to move along a predetermined orbit around an axis of said rotary shaft, wherein gas is introduced into and compressed in said fluid pocket;

a boss formed with said second surface of said movable scroll;

a bushing supported on said eccentric pin and rotatably received by said boss;

said rotary shaft having an inner end surface for securely supporting said eccentric pin;

a holding member engaging said eccentric pin to hold said bushing in a predetermined position on said eccentric pin in cooperation with said inner end surface of said rotary shaft;

said bushing including a first end surface contacting said inner end surface of said rotary shaft and a second end surface contacting said holding member; and a balance weight press fitted onto said bushing to cancel a dynamic imbalance of the movable scroll due to the orbital movement of said movable scroll.

9. The compressor as set forth in claim 8, wherein said balance weight comprises an end surface disposed between said first and second end surfaces of said bushing, said end surface of said balance weight being opposed to and spaced from said inner end surface of said rotary shaft.

10. The compressor as set forth in claim 8 therearound and said holding member has a ring shape conforming with said groove.

11. The compressor as set forth in claim 8, wherein said bushing comprises chrome steel, and wherein said balance weight comprises carbon steel.

12. The compressor as set forth in claim 8 further comprising a bearing disposed between said bushing and said boss.

13. The compressor as set forth in claim 8, wherein said balance weight has a ring-shaped fixed portion secured to said bushing and a weight portion integrally formed with said fixed portion, wherein said fixed portion is disposed between said boss and said inner end surface of said rotary shaft and said weight portion is rotatable around said boss.

14. The compressor as set forth in claim 13, wherein said eccentric pin has a groove extending therearound and said holding member has a ring shape conforming with said groove.

15. The compressor as set forth in claim 14, wherein said bushing comprises chrome steel, and wherein said balance weight comprises carbon steel.

16. The compressor as set forth in claim 15 further comprising a bearing disposed between said bushing and said boss.

17. The compressor as set forth in claim 16, wherein said balance weight has a ring-shaped fixed portion secured to said bushing and a weight portion integrally formed with said fixed portion, said fixed portion is disposed between the boss and said inner end surface of said rotary shaft, and said weight portion is rotatable around said boss.

18. A compressor comprising: a rotary shaft, a fixed scroll and a movable scroll having a first surface and a second surface, said first surface being opposed to said fixed scroll to define a displaceable fluid pocket, said movable scroll being supported on said rotary shaft via an eccentric pin to move along a predetermined orbit around an axis of said rotary shaft, wherein gas is introduced into and compressed in said fluid pocket;

a boss formed with said second surface of said movable scroll;

a bushing supported on said eccentric pin and rotatably received by said boss;

said rotary shaft having an inner end surface for securely supporting said eccentric pin;

a holding member engaging said eccentric pin to hold said bushing in a predetermined position on said eccentric pin in cooperation with said inner end surface of said rotary shaft;

said bushing including a first end surface contacting said inner end surface of said rotary shaft and a second end surface contacting said holding member;

a balance weight press fitted onto said bushing to cancel a dynamic imbalance of said movable scroll due to the orbital movement of said movable scroll; and said balance weight including an end surface disposed between said first and second end surfaces of said bushing, said end surface of said balance weight being opposed to and spaced from said inner end surface of said rotary shaft.

19. A compressor comprising: a rotary shaft, a fixed scroll, a movable scroll having a first surface and a second surface, said first surface being opposed to said fixed scroll to define a displaceable fluid pocket, said movable scroll being supported on said rotary shaft via an eccentric pin for movement along a predetermined orbit around an axis of said rotary shaft, wherein gas is introduced into and compressed in said fluid pocket;

a boss formed with said second surface of said movable scroll;

a bushing comprising chrome steel being supported on said eccentric pin and rotatably received by said boss;

said rotary shaft having an inner end surface for securely supporting said eccentric pin;

a holding member engaging said eccentric pin to hold said bushing in a predetermined position on said eccentric pin in cooperation with said inner end surface of said rotary shaft; and a balance weight comprising carbon steel being secured around said bushing to cancel a dynamic imbalance of said movable scroll due to the orbital movement of said movable scroll.

20. A compressor comprising: a rotary shaft, a fixed scroll and a movable scroll having a first surface and a second surface, said first surface being opposed to said fixed scroll to define a displaceable fluid pocket, said movable scroll being supported on said rotary shaft via an eccentric pin to move along a predetermined orbit around an axis of said rotary shaft, wherein gas is introduced into and compressed in said fluid pocket;

a boss formed with said second surface of said movable scroll;

a bushing supported on said eccentric pin and rotatably received by said boss;

said rotary shaft having an inner end surface for securely supporting said eccentric pin;

a holding member engaging said eccentric pin to hold said bushing in a predetermined position on said eccentric pin in cooperation with said inner end surface of said rotary shaft; and a balance weight secured around said bushing to cancel a dynamic imbalance of said movable scroll due to said orbital movement of said movable scroll, said balance weight having a ring-shaped fixed portion secured to said bushing and a weight portion integrally formed with said fixed portion.

21. The compressor as set forth in claim 20, wherein said fixed portion is disposed between said boss and said inner end surface of said rotary shaft, and said weight portion is rotatable around said boss.

22. The compressor as set forth in claim 20, wherein said eccentric pin has a groove extending therearound, and said holding member has a ring shape conforming with said groove.

* * * * *

UNITED STATES PATENT AND TRADEMARK OFFICE

CERTIFICATE OF CORRECTION

PATENT NO. : 5,597,297

DATED : January 28, 1997

INVENTOR(S) : Yamamoto et al

It is certified that error appears in the above-indentified patent and that said Letters Patent is hereby corrected as shown below:

Column 1, line 55, after "maximized" insert period --.--;
line 56, after "level" delete "gets".

Column 2, line 67, before "a boss" insert --with--.

Column 3, line 53, "25a" should read --25c--.

Signed and Sealed this

Second Day of September, 1997

*Attest:*

*Attesting Officer*

BRUCE LEHMAN

*Commissioner of Patents and Trademarks*